US009188112B2

(12) United States Patent
Yi et al.

(10) Patent No.: US 9,188,112 B2
(45) Date of Patent: Nov. 17, 2015

(54) DISTRIBUTING VALVE FOR CONCRETE PUMP AND THE CONCRETE PUMP

(75) Inventors: Xiaogang Yi, Hunan (CN); Hong Zhu, Hunan (CN); Liangrong Li, Hunan (CN)

(73) Assignees: HUNAN SANY INTELLIGENT CONTROL EQUIPMENT CO., LTD., Hunan (CN); SANY HEAVY INDUSTRY CO., LTD., Hunan (CN)

( * ) Notice: Subject to any disclaimer, the term of this patent is extended or adjusted under 35 U.S.C. 154(b) by 373 days.

(21) Appl. No.: 13/641,335

(22) PCT Filed: Apr. 18, 2011

(86) PCT No.: PCT/CN2011/072962

§ 371 (c)(1), (2), (4) Date: Oct. 15, 2012

(87) PCT Pub. No.: WO2011/127842

PCT Pub. Date: Oct. 20, 2011

(65) Prior Publication Data

US 2013/0034457 A1 Feb. 7, 2013

(30) Foreign Application Priority Data

Apr. 16, 2010 (CN) ..... 2010 1 0164558

(51) Int. Cl.

| | |
|---|---|
| ***F04B 15/00*** | (2006.01) |
| ***F04B 15/02*** | (2006.01) |
| ***F04B 7/00*** | (2006.01) |
| ***F04B 11/00*** | (2006.01) |

(52) U.S. Cl.

CPC ..... *F04B 15/023* (2013.01); *F04B 7/008* (2013.01); *F04B 7/0034* (2013.01); *F04B 11/005* (2013.01); *Y10S 417/90* (2013.01)

(58) Field of Classification Search

CPC ..... F04B 7/008; F04B 7/0034; F04B 11/005; F04B 15/023; Y10S 417/90

USPC ..... 417/516–519, 900; 137/826; 251/176

See application file for complete search history.

(56) References Cited

U.S. PATENT DOCUMENTS

| | | | | |
|---|---|---|---|---|
| 3,804,556 | A * | 4/1974 | Katzer et al. | 417/390 |
| 4,569,642 | A * | 2/1986 | Dwyer | 417/516 |

(Continued)

FOREIGN PATENT DOCUMENTS

| | | | |
|---|---|---|---|
| CN | 101245866 | A | 8/2008 |
| CN | 101832259 | A | 9/2010 |
| CN | 201627711 | U | 11/2010 |
| GB | 1418750 | A | 12/1975 |

(Continued)

OTHER PUBLICATIONS

International Search Report in International Application No. PCT/CN2011/072962, filed Apr. 18, 2011.

*Primary Examiner* — Charles Freay
*Assistant Examiner* — Patrick Hamo
(74) *Attorney, Agent, or Firm* — Saliwanchik, Lloyd & Eisenschenk

(57) ABSTRACT

A distributing valve for a concrete pump and the concrete pump are provided, the distributing valve comprises a valve body (200) and a valve core (300), and a delivering cavity (213) is internally formed in the valve body (200) and is provided with a material inlet, a material outlet (212) and material suction openings (251,252). The material outlet (212) is communicated with a delivery pipe and the material suction opening (251,252) is communicated with a delivery cylinder (500). The valve core (300) is a L-shaped pipe formed by a first pipe section (310) and a second pipe section (320), and one end of the L-shaped pipe is connected with a hopper (600) and a revolution fitting surface is formed between the end face of the other end of the L-shaped pipe and the internal face of the valve body (200).

7 Claims, 5 Drawing Sheets

(56) References Cited

U.S. PATENT DOCUMENTS

| | | | | |
|---|---|---|---|---|
| 5,251,663 | A * | 10/1993 | Christianson et al. | 137/876 |
| 6,793,467 | B2 * | 9/2004 | Hudelmaier | 417/379 |

FOREIGN PATENT DOCUMENTS

| | | | |
|---|---|---|---|
| IT | 1069719 | B | 3/1985 |
| KR | 10-2003-0031390 | A | 4/2003 |

* cited by examiner

DISTRIBUTING VALVE FOR CONCRETE PUMP AND THE CONCRETE PUMP

CROSS-REFERENCE TO RELATED APPLICATIONS

This application is the U.S. national stage application of International Patent Application No. PCT/CN2011/072962, filed Apr. 18, 2011, which claims priority to Chinese Patent Application No. 201010164558.5, filed Apr. 16, 2010, the disclosures of each of which are incorporated herein by reference in their entirety.

REFERENCE APPLICATION

This application claims the priority of Chinese Patent Application No. 201010164558.5, entitled "DISTRIBUTING VALVE FOR CONCRETE PUMP, AND CONCRETE PUMP" filed on Apr. 16, 2010 with State Intellectual Property Office of PRC.

FIELD OF THE INVENTION

The present invention relates to a concrete pump technique, in particular to a distributing valve for concrete pump and to a concrete pump with this distributing valve.

BACKGROUND OF THE INVENTION

A concrete pump is one of widely used concrete machinery presently. The concrete pump generally includes a hopper, a delivery cylinder, a distributing valve and a delivery pipe. The hopper is adapted to store concrete slurry. The delivery cylinder makes reciprocating movements under driving of a hydraulic cylinder. The distributing valve is used to communicate the delivery cylinder with the hopper during the first predetermined time period so that the delivery cylinder sucks material, specifically appropriate amount of concrete slurry; and to communicate the delivery cylinder with the delivery pipe during the second predetermined time period so that the delivery cylinder pumps material, specifically pushes the sucked concrete slurry into the delivery pipe and conveys the sucked concrete slurry to a predetermined position under pressure of the delivery cylinder. The distributing valve is one of the key components for the concrete pump.

Distributing valves for the concrete pump mainly comprise a gate-type distributing valve, an S-type distributing valve, a C-type distributing valve and a skirt valve.

The gate-type distributing valve makes the delivery cylinder suck and pump material mainly by means of the up-down movement of two gates in the distributing valve, which communicates a delivery cylinder with an outlet of a hopper during the first predetermined time period to make the delivery cylinder suck material and communicates the delivery cylinder with a delivery pipe during the second predetermined time period via a Y-type pipe to make the delivery cylinder pump material. The advantage of the gate-type distributing valve is that the concrete pump has a better sucking performance and better pumping efficiency. In particular for coarse aggregate concrete, the above-mentioned advantage is more significant. However, the disadvantage of the gate-type distributing valve is that the pressure of the concrete slurry in the delivery pipe is limited by the fitting position of the periphery of the gate since the position between the delivery cylinder and the delivery pipe is realized by switching the gates positions. Thus the gate-type distributing valve can not meet the requirement of pumping concrete slurry at a high pressure.

Referring to FIG. 1, a structural view of an S-type distributing valve in the prior art is shown. In FIG. 1, a hopper 110 is shown in double dot dash line. The S-type distributing valve includes an S-type bend pipe 120, which is mounted in the hopper 110. The input end of the S-type bend pipe 120 may swing laterally in the hopper 110 under the driving of a driving mechanism 130 to communicate with the two delivery cylinders 140 alternately. An output end of the S-type bend pipe 120 is in communication with a delivery pipe located outside of the hopper 110. Thus, the two delivery cylinders 140 may pump concrete slurry to the delivery pipe via the S-type bend pipe 120 alternately. The advantage of the S-type distributing valve is that, since the high pressure produced during pumping material by the delivery cylinder mainly acts on the inner wall of the S-type bend pipe, there is a uniform tensile stress on the whole S-type bend pipe which has a circular cross section, therefore the S-type distributing valve may withstand relatively great pressure. The operating pressure may be up to 16 Mpa or even more. Therefore, by utilizing the S-type distributing valve, the concrete pump may pump concrete slurry to a longer distance or to a higher position, so as to meet the requirement of pumping the concrete slurry at high pressure. However, the disadvantage of the S-type distributing valve is that the S-type bend pipe of the S-type distributing valve is located in the hopper 110 and occupies a part of volume of the hopper 110, so as badly affects the flowing of concrete slurry, thus affecting the sucking performance of the concrete pump. In addition, the S-type bend pipe is located in the hopper 110, so that it leads to material deposit in the hopper easily.

The C-type distributing valve and the skirt valve have the similar working principle as the S-type distributing valve, and thus have the same defects.

In view of the defects of the above existing distributing valves, Chinese patent publication No. CN 101245866A discloses a distributing valve for a concrete pump. The distributing valve includes a valve body and a valve core which is arranged in the valve body. The valve body is provided with a material outlet, a first material suction port and a second material suction port. The valve core is provided with an upper extension shaft and a lower extension shaft, through which the valve core is rotatably mounted on the valve body, a bearing and a sealing mechanism are respectively mounted between the upper extension shaft and the valve body and between the lower extension shaft and the valve body; the valve core takes the axis of the upper extension shaft and the lower extension shaft as a central line, and rotates respect i n g to the valve body for a certain angle to form a left limit position and a right limit position; the valve core also comprises a side opening and a material inlet which is communicated with a hopper. When the valve core rotates to the left limit position, the side opening is communicated with the first material suction port. When the valve core rotates to the right limit position, the side opening is communicated with the second material suction port.

When the concrete distribution valve disclosed in CN 101245866A is used, the usage volume of the hopper may be increased due to the separate arrangement of the distribution valve and the hopper, so that the blades in the hopper stir more sufficiently; the material inlet is oriented straight downward, so as to facilitate material input, in particular for pumping of coarse aggregate, and to improve the material suction performance of the concrete pump, to avoid the material depositing in the hopper and to make the cleaning of the hopper very easily; during the pumping process, as a passage which is communicated with the first material suction port, the second material suction port and the material outlet is arranged between the valve core and the valve body of the distribution valve, the valve body is able to keep the passage sealed, thus the requirement of pumping concrete slurry at a high pressure can be met. But the distribution valve has the following defects:

In order to meet the requirement of pumping concrete slurry at a high pressure, a very high pressure shall be established in the valve body; as the valve body and the valve core are rotatably matched at the matching point, so it is essential to keep the performance of the dynamic seal at the matching point of the valve body and the valve core so as to ensure the working performance of the distribution valve. In order to ensure the sealing of the rotation match between the valve body and the valve core, in CN 101245866A, the upper end of the valve core is provided with an upper extension shaft and a step surface, and the lower end is provided with a lower extension shaft and a step surface so as to arrange a sealing gasket between the bottom surface of the cover plate and the valve core as well as between the valve body and the bottom surface of the valve core; in order to increase the service life of the distribution valve, it is also needed to arrange an abrasion resistance plate between the cover plate and the sealing gasket as well as between the valve body and the sealing gasket; in order to facilitate switching the state of the distribution valve, a guide plate is also arranged between the abrasion resistance plate and the sealing gasket. The above said configuration makes the distribution valve have very complex structure, therefore it leads to complex and difficult production process, and it is difficult to ensure the operation reliability of the distribution valve. Furthermore, the valve core can move up and down, the fit clearance of any step surface of the distribution valve can be embodied in the fit clearance of another step surface, so that the upper and lower two step surfaces will enlarge the fit clearance between the valve body and the valve core, decrease the sealing useful-life between the valve body and the valve core and thereby decrease the serve life of the distribution valve.

As the upper extension shaft and the lower extension shaft are rotatably connected to the valve body respectively, the complex structure and the sealing requirement make the rotation fit surface relatively large between the valve body and the valve core, so that the power required by the state switching of the distribution valve is increased, and thereby the power consumption of the concrete pump vehicle is increased.

SUMMARY OF THE INVENTION

In view of the defects of the concrete distributing valve mentioned above, the first aspect of the present invention is to provide a distributing valve for a concrete pump which has simple structure, high reliability, long service life and low production costs so as to reduce power consumption and keep a good material sucking performance while meeting the requirement for pumping concrete slurry at a high pressure.

Based on the above distributing valve, the second aspect of the present invention is to provide a concrete pump which has the distributing valve described above.

In order to achieve the first aspect, the distributing valve for a concrete pump according to the present invention includes a valve body and a valve core; and a delivering cavity is formed in the valve body and the valve body is provided with a material outlet, a material inlet and a first material suction opening; the material outlet is communicated with a delivery pipe and the first material suction opening is communicated with a delivery cylinder. The valve core is a pipe-shaped structure formed by a first pipe section and a second pipe section, and located in the delivering cavity; the first pipe section extends vertically, and is rotatably fitted with the material inlet; the second pipe section extends transversely in the delivering cavity and its inner end is connected to the lower end of the first pipe section, and a fitting surface of revolution is formed between the end face of the outer end and the internal face of the delivering cavity; the first pipe section is fitted with the vale body by sealing fitting, and the second pipe section is also; the valve core is driven by a driving mechanism and can be switched between a first position where the outer end of the second pipe section is in communication with the first material suction opening and a second position where the first material suction opening is in communication with the material outlet via the delivering cavity.

Furthermore, the valve body has a second material suction opening in communication with another delivery cylinder; in the first position, the second material suction opening is in communication with the material outlet via the delivering cavity, and in the second position, the outer end of the second pipe section is in communication with the second material suction opening.

Furthermore, the second pipe section comprises a second pipe section body which inner end is connected to the lower end of the first pipe section, and a clamp ring which is mounted on the outer end of the second pipe section body.

Furthermore, a spring means is mounted between the clamp ring and the second pipe section body.

Furthermore, the valve body also comprises a wear resistant plate, in which the first material suction opening and the second material suction opening are located.

Furthermore, there is a smooth transition between the first pipe section and the second pipe section.

Furthermore, the intersection line of the revolution fitting surface and the reference plane is an outer convex arc, and the reference plane passes through the central line of the first pipe section.

In order to achieve the second aspect, the concrete pump according to the present invention includes a hopper, a delivery cylinder, a delivery pipe, a driving mechanism and anyone of the distributing valves for a concrete pump mentioned above, wherein the central line of the first pipe section is perpendicular to the axis of the delivery cylinder.

Furthermore, the driving mechanism is connected to the first pipe section.

Furthermore, the distributing valve for a concrete pump also includes a driving shaft, the central line of which coincides with that of the first pipe section, the inner end of the driving shaft is fixed to the lower end of the first pipe section, and the outer end thereof protrudes from the valve body and is connected with the driving mechanism.

Compared with the prior art, the distributing valve for a concrete pump according to the present invention is located at a predetermined position outside of the hopper. The valve core includes a first pipe section and a second pipe section, the first pipe section extends vertically, and its outer wall surface is rotatably connected to the hole wall surface of the valve body; the second pipe section extends transversely in the delivering cavity and its inner end is connected to the lower end of the first pipe section, and a revolution fitting surface is formed between the end face of the outer end of the second pipe section and the inner wall surface of the delivering cavity. Thus, an L-shaped pipe is formed by the first pipe section and the second pipe section of the valve core, and the first pipe section is rotatably connected with the valve body, and a revolution fitting surface is formed between the outer end of the second pipe section and the inner wall surface of the delivering cavity. Compared with the distributing valve in the prior art CN1012445866A, the sealing arrangement is only provided above the valve body and no revolution fitting step face is needed; thereby the structure of the distributing valve for a concrete pump is simplified greatly, so as to make the manufacturing of the distributing valve more easily and simply, and improve the working reliability of the distributing valve, and reduce its manufacturing cost; due to the absence of the step face, the useful-life of sealing between the valve body and the valve core may be increased and sealing is ensured, the maintenance period of the distributing valve is increased and thereby the serve life of the distribution valve is also prolonged; as the fitting surface between the valve core and the valve body is reduced, and the friction force between them is reduced as well, thereby the power required by the rotation of the valve core may be decreased and the power consumption of the distributing valve for a concrete pump will be reduced. In addition, the fitting between the first and second pipe sections and the valve body is respectively seal fitting, therefore, it can meet the demand of delivering concrete slurry at high pressure while retaining fine suction capability.

In a further preferred technical solution, the valve body also includes a second material suction opening communicating with another delivery cylinder. In the first position, while one delivery cylinder suck material through the valve core, the second material suction opening is communicated with the material outlet, and another delivery cylinder in communication with the second material suction opening can pump the concrete slurry that is sucked in the former phase through the delivering cavity; in the second position, while one delivery cylinder pumps material, the valve core is communicated with the second material suction opening, now another delivery cylinder may suck material via the valve core to prepare for the next phase of pumping material. By means of the distributing valve according to this technical solution, the concrete pump can pump concrete slurry to outside at relatively higher frequency so that the pumping efficiency of the concrete pump is increased.

In a further preferred technical solution, a spring means is mounted between the clamp ring of the second pipe section and the second pipe section body, so that a close fitting of the revolution fitting surface between the clamp ring and the wear resistant plate can be kept and a good separation between the inner chamber of the valve core and the delivery cavity is ensured, thereby the demand of delivering concrete slurry at high pressure is met better.

In a further preferred technical solution, the intersection line of the fitting surface and the reference plane is an outer convex arc, so that the revolution fitting surface forms a structure with an outer convex middle portion and an inwardly extending periphery portion. This structure can be automatically aligned and keep sealed when the second pipe section fits the inner wall surface of the valve body; and this structure also enable the valve body to provide a certain supporting force for the valve core so as to improve the working stability and reliability of the distributing valve.

Based on the above distributing valve for a concrete pump, the concrete pump with anyone of the distributing valves discussed above is also provided with the corresponding technical effects.

DETAILED DESCRIPTION OF THE PRESENT INVENTION

In order to ensure the sealing performance of the delivery cavity and meet the demand of delivering concrete slurry at a high pressure, it is designed a complex sealing structure in the prior art to improve and ensure the sealing performance of the delivery cavity. The core of the present invention lies in overcoming the technical prejudice of realizing the sealing performance of the delivery cavity via a sealing structure in the prior art, and providing a distributing valve for a concrete pump of a simple structure, high reliability, long service life and low manufacturing cost by changing the structure of the distributing valve, thereby realizing the object of the present invention.

The present invention will be described in detail hereinafter in conjunction with the drawings. The description in this section is only illustrative and explanatory, and should not be considered to limit the protection scope of the present invention. It should be noted that although technical solutions according to the present invention is suitable for pumping concrete, the technical solutions are also applied to pump mud or other sticky material which has the same properties as concrete slurry.

Figure 1:
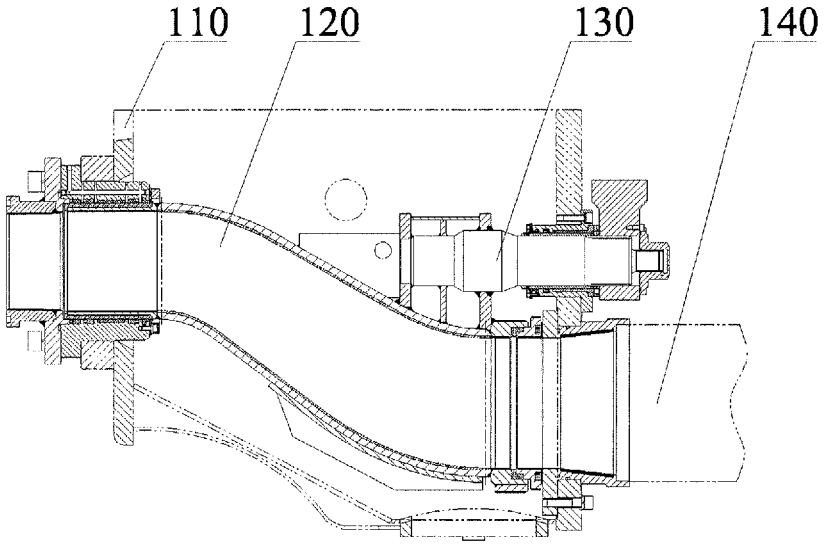
Fig. 1 (Prior Art)
FIG. 1 is a structural view of an S-type distributing valve in the prior art.
Figure 2:
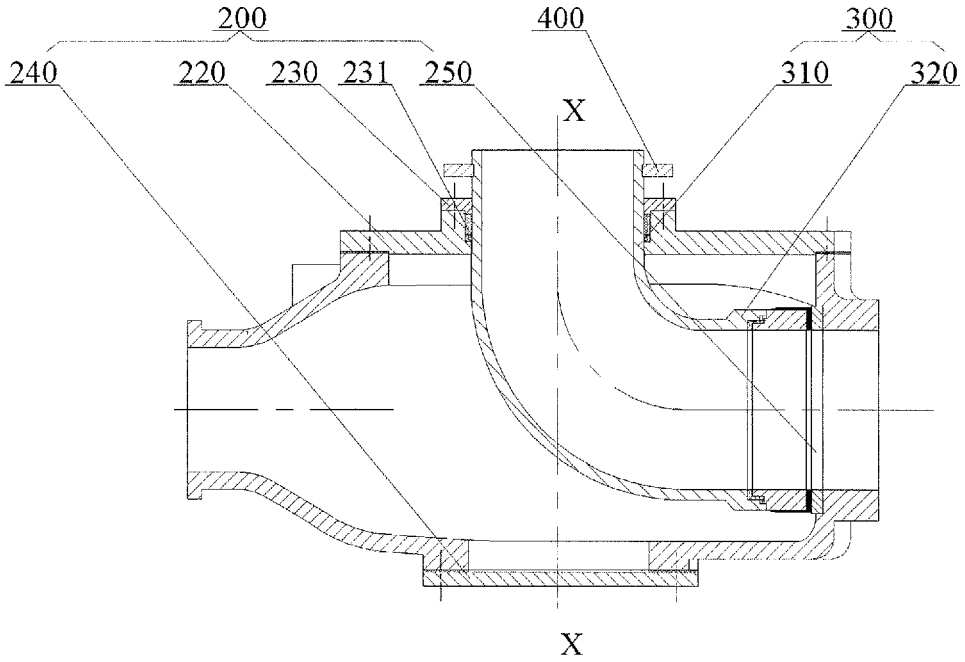
FIG. 2 is a schematic mounting structural view of a distributing valve for a concrete pump according to an embodiment of the present invention.
Figure 3:
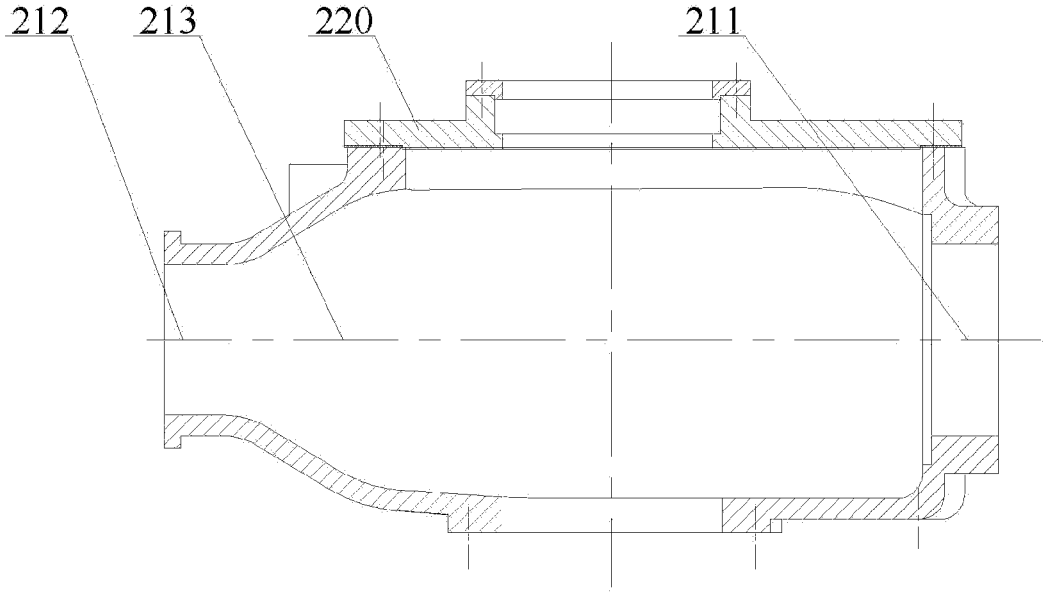
FIG. 3 is a sectional structural view of the valve body of the distributing valve for a concrete pump according to the embodiment of the present invention.

Referring to FIG. 2, it is a schematic mounting structural view of a distributing valve for a concrete pump according to the first embodiment of the present invention. FIG. 3 is a schematic sectional structural view of the valve body of the distributing valve for a concrete pump shown in FIG. 2. In the following description, taking FIG. 2 as a reference, the right side is defined as the front and the left side is defined as the rear.

A distributing valve for a concrete pump according to the first embodiment includes a valve body 200 and a valve core 300. In conjunction with FIG. 3, the valve body 200 is a housing structure, including a front sidewall, a rear sidewall, a top wall and a bottom wall, and a hollow cavity is internally formed in the valve body, this hollow cavity is a delivery cavity 213. The front sidewall has an opening 211, opposite which a wear resistant plate 250 is arranged. The rear sidewall has a material outlet 212 in communication with a delivery pipe which can deliver the concrete slurry to a predetermined position. The top wall has a cover plate 220, which is provided with a material inlet corresponding to the first pipe section 310; the bottom wall has a material discharge plate 240, which can be disassembled or removed when the concrete pump stops operation, so as to remove the concrete slurry staying in the delivery cavity 213.

Figure 4:
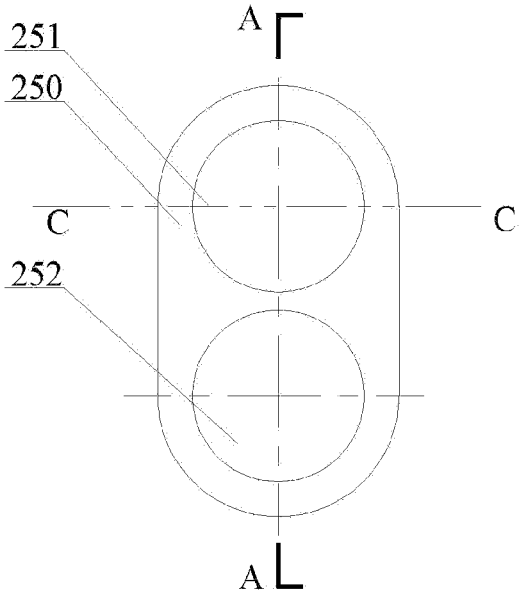
FIG. 4 is a structural view of the wear resistant plate of the distributing valve for a concrete pump according to the embodiment of the present invention.
Figure 5:
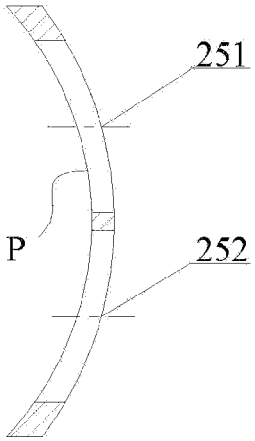
FIG. 5 is a sectional structural view through A-A in FIG. 4.

Referring to FIGS. 4 and 5, FIG. 4 is a structural view of the wear resistant plate of a distributing valve for a concrete pump according to the first embodiment of the present invention, and FIG. 5 is a sectional structural view through A-A in FIG. 4. The wear resistant plate 250 includes two material suction openings. For convenient description, two material suction openings are respectively named as the first material suction opening 251 and the second material suction opening 252, which are communicated with two delivery cylinders of the concrete pump respectively via the opening 211. The wear resistant surface of the wear resistant plate 250 is the operating plane P facing the delivery cavity 213. As shown in FIG. 5, the operating plane P is a concave curved surface extending along the swing direction of the clamp ring 322. The wear resistant plate 250 may be the same as the glasses plate in the concrete pump in the prior art except the shape of its operating plane to have predetermined impact resistance and wear resistance.

Figure 6:
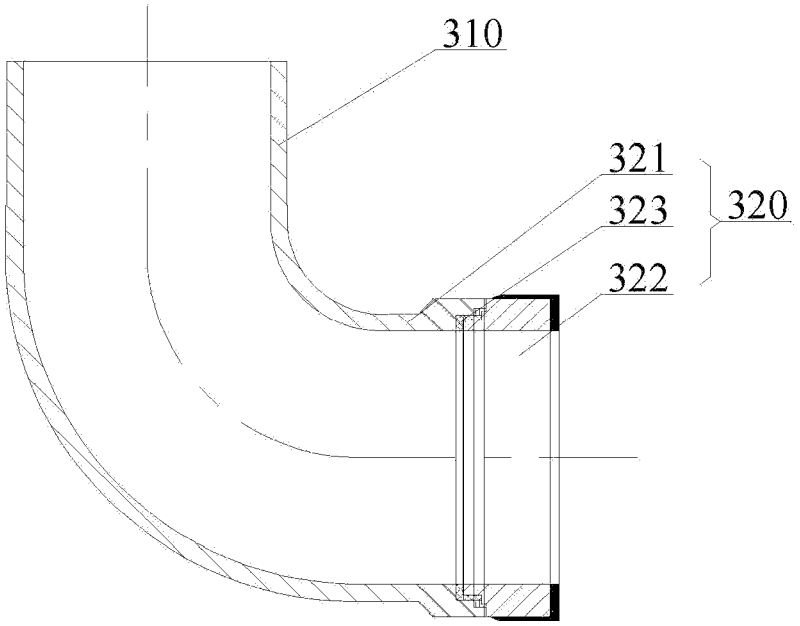
FIG. 6 is a sectional structural view of the valve core of the distributing valve for a concrete pump according to the embodiment of the present invention.

Referring to FIG. 6, FIG. 6 is a sectional structural view of the valve core of a distributing valve for a concrete pump according to the first embodiment of the present invention. The valve core 300 is a pipe-shaped structure formed by a first pipe section 310 and a second pipe section 320; the first pipe section 310 basically extends vertically; the second pipe section 320 extends transversely in the delivering cavity and its inner end is connected to the lower end of the first pipe section 310, and a revolution fitting surface is formed between the end face of the outer end and the internal wall face of the delivering cavity 213; thus the first pipe section 310 and the second pipe section 320 form a L-shaped pipe. In order to reduce the flow resistance of the concrete slurry, it is better to provide a smooth transition between the first pipe section 310 and the second pipe section 320. In addition, the first pipe section 310 may be inclined at a predetermined angle according to the position of the hopper.

As there is a movement fitting between the outer end of the second pipe section 320 and the inner wall surface of the delivering cavity 213, in order to reduce the wear rate of the second pipe section 320, in the present embodiment, the second pipe section 320 is provided with a clamp ring 322. Referring to FIG. 6, the second pipe section 320 comprises a second pipe section body 321, the inner end of which is connected to the lower end of the first pipe section 310, and a clamp ring 322 which is mounted on the outer end of the second pipe section body 321, and the outer end surface of which forms the outer end surface of the second pipe section 320.

Figure 7:
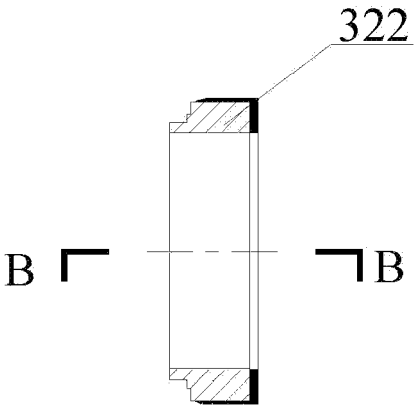
FIG. 7 is a sectional structural view of the clamp ring of a distributing valve for a concrete pump according to the embodiment of the present invention.
Figure 8:
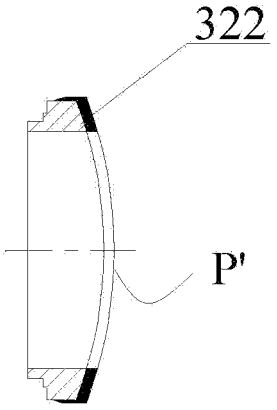
FIG. 8 is a sectional structural view through B-B in FIG. 7.

Referring to FIGS. 7 and 8, FIG. 7 is a sectional structural view of the clamp ring; FIG. 8 is sectional structural view through B-B in FIG. 7. The operating plane P' of the clamp ring 322 is an outer convex curved surface and matches with the operating plane P of the wear resistant plate 250 and has the same curvature as the operating plane P. Except the shape of its operating plane, the clamp ring 322 may be identical to the cutting ring in the concrete pump in the prior art to have predetermined impact resistance and wear resistance.

The valve core 300 is able to move relative to the valve body 200 under the driving of the predetermined driving mechanism, and can be switched between a first position and a second position; during the position switching of the valve core 300, the operating plane P' of the clamp ring 322 slides along the operating plane P of the wear resistant plate 250, these two planes fits each other in a sealing manner and form a revolution fitting surface to separate the inner chamber of the valve core 300 from the delivering cavity 213 so as to meet the demand of pumping the concrete at high pressure. The revolution fitting surface refers to a fitting surface between the operating plane P' of the clamp ring 322 and the operating plane P of the wear resistant plate 250 when the clamp ring 322 is rotated with the valve core 300.

Referring to FIG. 6 again, in order to keep the clamp force between the clamp ring 322 and the wear resistant plate 250, a rubber spring 323 may be provided between the clamp ring 322 and the second pipe section 321, this rubber spring 323, on the one hand, can keep a predetermined pressure between the clamp ring 322 and the wear resistant plate 250, on the other hand, it may compensate the variation of the fitting space between the clamp ring 322 and the wear resistant plate 250 due to the friction wear of the clamp ring 322 and/or the wear resistant plate 250, so as to ensure the sealing fitting between them. In addition, the above object can also be realized by means of other spring mechanism and spring means provided in the prior art, namely other spring mechanism or spring means is provided between the clamp ring 322 and the second pipe section body 321.

Referring to FIG. 2, the upper end of the first pipe section 310 protrudes from the valve body 200, and its outer wall surface close to the upper end portion is rotatably fitted with the wall surface of the material inlet on the cover plate 220 to assemble the L-shaped pipe of the valve core 300 and the valve body together, the rotation axis X-X coincides with the central line of the first pipe section 310. The fitting between the first pipe section 310 and the material inlet is a rotatable sealing fitting; in this embodiment, a wear-resistant sealing ring 231 is provided between the first pipe section 310 and the wall surface of the material inlet and is located in a groove in the cover plate 220 and is positioned at its upper end via a positioning plate 230 so as to retain the wear-resistant sealing ring 231 between the first pipe section 310 and the cover plate 220 for ensuring the sealing performance of the delivering cavity 213; this can also reducing the friction force between the first pipe section 310 and the inner wall surface of the material inlet of the cover plate 220 and prolong the service life of the distributing valve. As experiment shown, the wear-resistant sealing ring 231 can ensure that the distributing valve has a predefined sealing performance so that the distributing valve has a suitable maintenance period and meet the demand of pumping concrete slurry under a high pressure.

Hereinafter, the operating principle of the distributing valve for a concrete pump according to the first embodiment will be described in conjunction with the concrete pump. For the convenience of description, the delivery cylinder in communication with the first material suction opening 251 is referred to as the first delivery cylinder, and the delivery cylinder in communication with the second material suction opening 252 is referred to as the second delivery cylinder.

Figure 9:
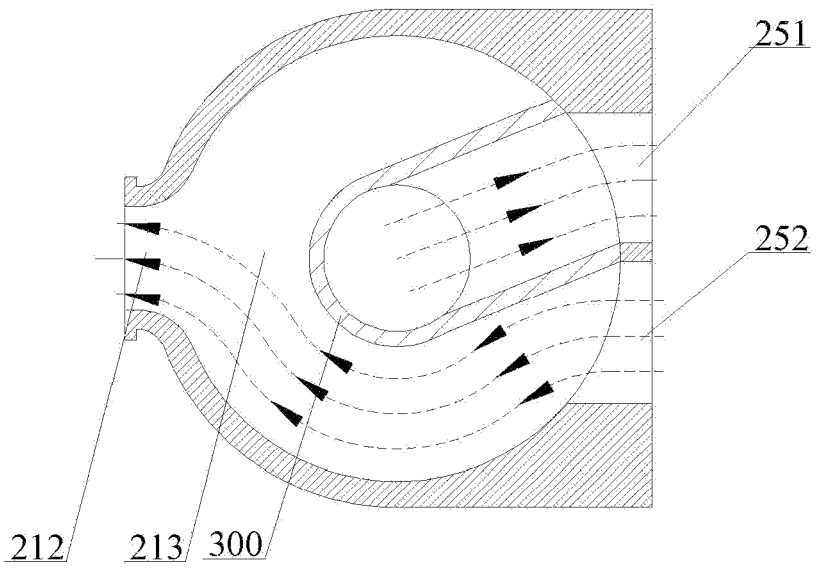
FIG. 9 is a work principle schematic view of a distributing valve when the valve core of the distributing valve for a concrete pump according to the embodiment of the present invention is in the first position.

Referring to FIG. 9, it is an operating principle view of a distributing valve when the valve core of the distributing valve for a concrete pump according to the first embodiment is in the first position. The valve core 300 is driven by a driving mechanism 400 to rotate by taking the rotation axis X-X as the central line, when the valve core 300 is in a first position, the hole of the clamp ring 322 is communicated with the first material suction opening 251, and the second material suction opening 252 is communicated with the material outlet 212 via the delivering cavity 213. Now the piston of the first delivery cylinder retracts, and a proper amount of concrete slurry is sucked from the hopper via the valve core 300 to implement material suction. At the same time, the piston of the second delivery cylinder protrudes to press the concrete slurry in the former phase in the second delivery cylinder out so that the concrete slurry passes through a space formed by the outer wall surface of the valve core 300 and the inner wall surface of the delivering cavity 213 and enters the delivery pipe through the material outlet 212 to realize pumping of the concrete slurry.

Figure 10:
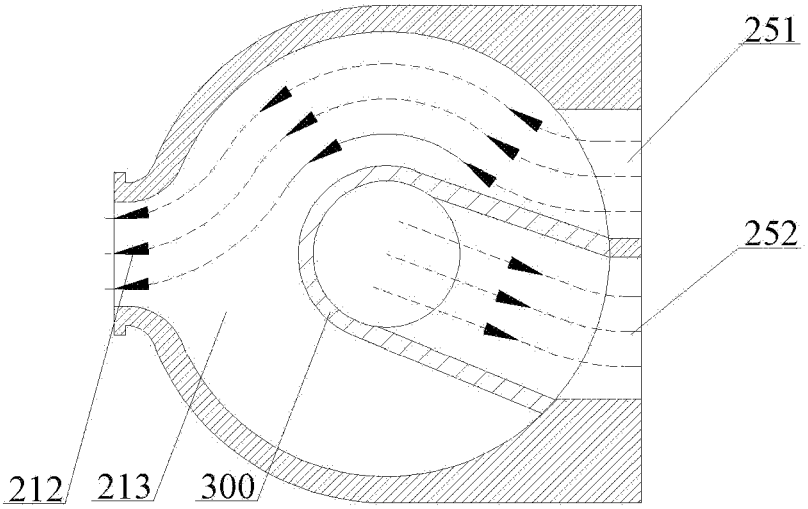
FIG. 10 is a work principle schematic view of a distributing valve when the valve core of the distributing valve for a concrete pump according to the embodiment of the present invention is in the second position.

Referring to FIG. 10, it is an operating principle view of a distributing valve when the valve core of the distributing valve for a concrete pump according to the first embodiment is in the second position. The valve core 300 is driven by a driving mechanism 400 to swing, when the valve core 300 is in a second position, the hole of the clamp ring 322 is communicated with the second material suction opening 252, and the first material suction opening 251 is communicated with the material outlet 212 via the delivering cavity 213. Now the piston of the second delivery cylinder retracts, and a proper amount of concrete slurry is sucked from the hopper via the valve core 300 to implement material suction. The piston of the first delivery cylinder protrudes to press the sucked concrete slurry in the former phase out so that the concrete slurry passes through a space formed by the outer wall surface of the valve core 300 and the inner wall surface of the delivering cavity 213 and enters the delivery pipe through the material outlet 212 to realize pumping of the concrete slurry. Then the valve core 300 is counter-rotated to return to the first position, and the above process is repeated so that the concrete pump can pump the concrete slurry to outside continuously.

As the distributing valve according to the first embodiment is located outside the hopper, and preferred under the hopper and is communicated with the outlet at the bottom of the hopper, thereby the self-flowing performance of concrete slurry may be fully utilized, so that the first delivery cylinder may more easily suck the concrete slurry; furthermore, it is possible to arrange a stirrer in the hopper to forcedly transport the concrete in the hopper into the first delivery cylinder, thus the material suction efficiency of the concrete pump is greatly improved. Moreover, the fitting between the first pipe section 310, the second pipe section 320 and the valve body 200 is sealing fitting respectively; when the concrete slurry is pumped to outside through the delivery cavity 213, it not only facilitates the pressure establishing in the delivery cavity, but also enables the high pressure of the concrete slurry to mainly apply to the inner wall surface of the delivery cavity 213 and the outer wall surface of the valve core 300, thereby the delivery cavity 213 uniformly bears the pressure and the distributing valve has a relatively high pressure withstanding capacity so as to meet the requirement of pumping concrete slurry at a high pressure. More importantly: in the distributing valve according to the present embodiment, the sealing arrangement is only provided above the valve body 200 and thereby the sealing of the delivery cavity 213 can be realized, and it is not necessary to respectively provide step faces on upper end and lower end of the valve core 300 for sealing the delivery cavity, thus the structure of the distributing valve for a concrete pump is simplified greatly, and the working reliability of the distributing valve is improved, so as to make the manufacturing of the distributing valve more easily and simply, reduce its manufacturing cost; due to the higher reliability of the distributing valve, the maintenance period of the distributing valve may be prolonged and thereby the serve life of the distribution valve is also prolonged; furthermore, as the fitting surface between the valve core 300 and the valve body 200 becomes smaller, and the friction force between them is reduced as well, thereby the power required by the rotation of the valve core 300 may be decreased and the power consumption of the distributing valve for a concrete pump will be reduced as well.

Figure 11:
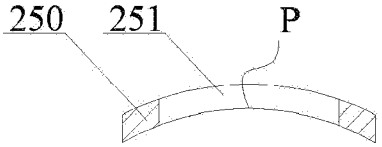
FIG. 11 is a sectional structural view through C-C reference plane in FIG. 4.

According to the above description, it can be understood, the wear resistant plate 250 can also be other structures. As shown in FIG. 11, it is a sectional structural view through C-C reference plane in FIG. 4; in FIG. 4, the C-C reference plane is perpendicular to the movement direction of the clamp ring 322 and is through the central line of the first pipe section 310. The intersection line of the C-C reference plane and the operation plane P of the wear resistant plate 250 is convex, preferred an outer convex arc; now the fitting surface between the clamp ring 322 and the wear resistant plate 250 coincides with the operation plane P, thus the intersection line of the fitting surface and the C-C reference plane is also an outer concave arc; thus the revolution fitting surface forms a structure with an outer convex middle portion and an inwardly extending periphery portion. This structure, on the one hand, can facilitate the alignment of the clamp ring 322 and the wear resistant plate 250 and enables the wear resistant plate 250 to provide a predefined supporting force for the valve core 300 in the vertical direction so as to improve the stability of the valve core 300 and work reliability of the distributing valve.

In addition, transverse extending of the second pipe section 320 means having a certain span in the transverse direction, thus the second pipe section 320 is not limited to extending in the horizontal direction, it can also extend inclined downwardly or upwardly, that is, making the angle formed by the central line of the second pipe section 320 and the central line of the first pipe section 310 be greater or smaller than 90-degree, forming a certain angle. In order to be adaptable to the concrete pumps of different configurations, the valve core 300 can also have different structures, the object of the present invention can be achieved, as long as the angle formed by the central line of the second pipe section 320 and the central line of the first pipe section 310 is not bigger than 180-degree.

According to the above description, it is also possible to only provide a first material suction opening 251 on the wear resistant plate 250 of the valve body 200. When only a first material suction opening 251 is provided, the outer end of the second pipe section 320 is communicated with the first material suction opening 251 when the valve core 300 is in the first position, at this time the delivery cylinder in communication with the first material suction opening 251 is enabled to suck material through the valve core 300; when the valve core 300 is in the second position, the delivery cylinder pumps the concrete slurry to the delivery pipe via the first material suction opening 251, the delivery cavity 213 and the material outlet 212, now the outer end of the second pipe section 320 fits the inner wall surface of the delivery cavity 213 in a sealed way. Thus, the object of the present invention can be achieved as well.

Based on the distributing valve for a concrete pump described above, the present invention further provides a concrete pump.

Figure 12:
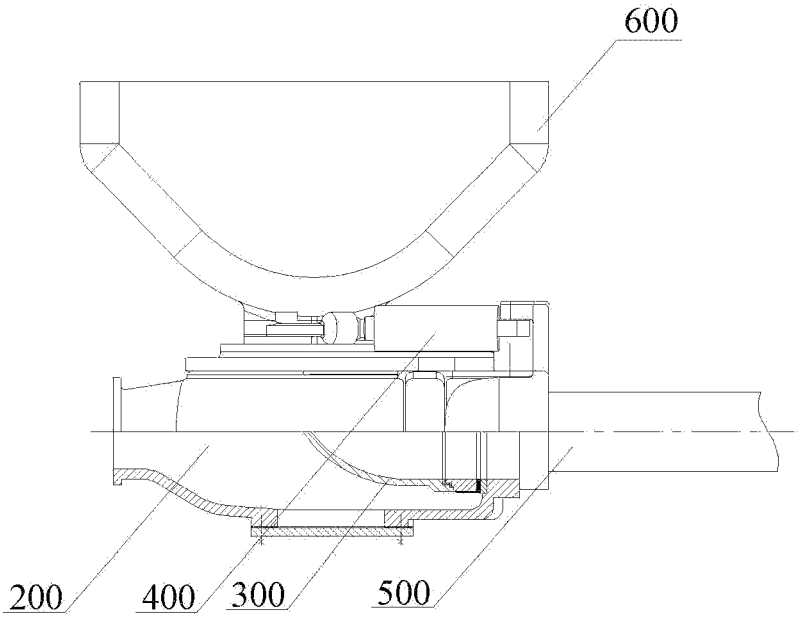
FIG. 12 is a schematic structural view of a concrete pump according to an embodiment of the present invention.

Referring to FIG. 12, it shows the structure of a concrete pump according to the present invention. The concrete pump according to the present invention includes a hopper 600, a delivery cylinder 500, a delivery pipe (not shown), a driving mechanism 400 and any distributing valve for a concrete pump described above, the distributing valve is under the hopper 600, and the input end of the valve core 300 is rotatably communicated with the outlet at the bottom of the hopper, the outlet of the hopper 600 is preferably opened downwardly and is located at the bottom of the hopper 600; the delivery cylinder 500 is communicated with the corresponding material suction opening of the wear resistant plate 250 so as to suck concrete slurry from the hopper 600, or pump concrete slurry to outside through the delivery cavity 213 of the distributing valve; the material outlet 212 is communicated with the delivery pipe so as to introduce the concrete slurry flowing out from the delivery cavity to a predetermined position. The driving mechanism 400 is used to drive the valve core 300 to perform position switching, and may include a rocker arm in connection with the first pipe section 310 and a driving mechanism for the rocker arm, which may be a hydraulic cylinder; the rocker arm may be connected to the input end of the first pipe section 310. The driving mechanism 400 may also be other structures in the prior art.

Figure 13:
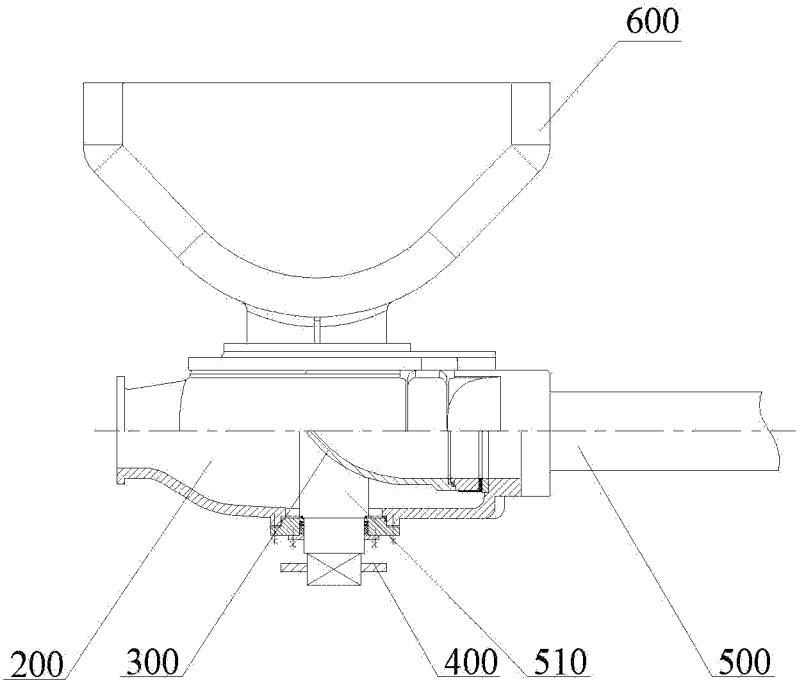
FIG. 13 is a schematic structural view of a concrete pump according to another embodiment of the present invention.

As shown in FIG. 13, it is a schematic structural view of another concrete pump according to the present invention, the distributing valve also includes a driving shaft 510, the inner end of which is fixed connected with the valve core 300, and the outer end of which protrudes from lower portion of the valve body 200, and the central line of the driving shaft 510 coincides with the rotation axis X-X; the driving mechanism 400 is located under the distributing valve and its rocker arm is connected to the outer end of the driving shaft 510. In the concrete pump, the driving mechanism 500 drives the valve core 300 via the driving shaft 510 to rotate in a predefined manner to realize switching between positions. It is possible to provide a driving mechanism 400 both above and under the distributing valve to ensure the work stability and reliability of the valve core 300.

The above-mentioned description is just the preferred embodiments of the present invention. It should be noted that some improvements, modifications and variations may be made by the skilled in the art without departing from the principles of the present invention, for example, in specific case it is possible to omit the clamp ring and/or wear resistant plate; and these improvements, modifications and variations should be deemed to fall into the scope of protection of the present invention.

The invention claimed is:

1. A concrete pump, including a hopper (600), a delivery cylinder (500), a delivery pipe and a driving mechanism (400), characterized in that, it further includes a distributing valve for the concrete pump, the distributing valve comprising a valve body (200) and a valve core (300), and a delivery cavity (213) internally formed in the valve body (200);

wherein the valve body (200) is provided with a material outlet (212), a material inlet and a first material suction opening (251);

wherein the material outlet (212) is communicated with the delivery pipe and the first material suction opening (251) is communicated with the delivery cylinder;

wherein the valve core (300) is a pipe structure formed by a first pipe section (310) and a second pipe section (320) in the delivery cavity;

wherein the delivery cavity (213) has an inner wall surfacei wherein the first pipe section (310) extends vertically, and is rotatably fitted with the material wherein the second pipe section (320) extends horizontally in the delivery cavity and has an inner end which is connected to a lower end of the first pipe section (310) and an outer end, and a revolution fitting surface is formed between an end face of the outer end of the second pipe section and the inner wall surface of the delivery cavity (213);

wherein a fitting between the first (310) and second (320) pipe sections and the valve body (200) is a seal fitting:

wherein the valve core (300) is driven by the driving mechanism (400) to be switched between a first position where the outer end of the second pipe section (320) is in communication with the first material suction opening (251) and a second position where the first material suction opening (251) is in communication with the material outlet (1212) via the delivery cavity (213);

wherein the central line of the first pipe section (310) is perpendicular to the axis of the delivery cylinder (500); and wherein the distributing valve for the concrete pump includes a driving shaft (510) having an inner end and an outer end, the central line of which coincides with that of the first pipe section (310), the inner end of the driving shaft is fixed to the lower end of the first pipe section (310), and the outer end of the driving shaft protrudes from the valve body (200) and is connected with the driving mechanism (400).

2. The concrete pump according to claim 1, wherein the valve body (200) has a second material suction opening (252) in communication with another delivery cylinder; wherein, in the first position, the second material suction opening is in communication with the material outlet (212) via the delivery cavity (213), and in the second position, the outer end of the second pipe section (320) is in communication with the second material suction opening (252).

3. The concrete pump according to claim 2, wherein the second pipe section (320) comprises a second pipe section body (321), the inner end of which is connected to the lower end of the first pipe section (310), and a clamp ring (322) which is mounted on the outer end of the second pipe section body (321).

4. The concrete pump according to claim 3, wherein a spring means (323) is mounted between the clamp ring (322) and the second pipe section body (321).

5. The concrete pump according to claim 2, wherein the valve body (200) also comprises a wear resistant plate (250), in which the first material suction opening (251) and the second material suction opening (252) are located.

6. The concrete pump according to claim 1, wherein a smooth transition is present between the first pipe section (310) and the second pipe section (320).

7. A concrete pump, including a hopper (600) and a distributing valve for a concrete pump, wherein the distributing valve comprises: a valve body (200) and a valve core (300), and a delivery cavity (213) is internally formed in the valve body (200) and the valve body (200) is provided with a material outlet (212), a material inlet and a first material suction opening (251), wherein the material outlet (212) is communicated with a delivery pipe and the first material suction opening (251) is communicated with a delivery cylinder, characterized in that, the valve core (300) is a pipe structure formed by a first pipe section (310) and a second pipe section (320) in the delivery cavity; the delivery cavity (213) has an inner wall surface; the first pipe section (310) extends vertically, and is rotatably fitted with the material inlet; the second pipe section (320) extends transversely in the delivery cavity and has an inner end which is connected to a lower end of the first pipe section (310) and an outer end, and a revolution fitting surface is formed between the end face of the outer end of the second pipe section and the inner wall surface of the delivery cavity (213); a fitting between the first (310) and second (320) pipe sections and the valve body (200) is a seal fitting; the valve core (300) is driven by a driving mechanism (400) to be switched between a first position where the outer end of the second pipe section (320) is in communication with the first material suction opening (251) and a second position where the first material suction opening (251) is in communication with the material outlet (212) via the delivery cavity (213), wherein the central line of the first pipe section (310) is perpendicular to the axis of the delivery cylinder, and wherein the distributing valve for a concrete pump includes a driving shaft (510) having an inner end and an outer end, the central line of which coincides with that of the first pipe section (310), the inner end of the driving shaft is fixed to the lower end of the first pipe section (310), and the outer end of the driving shaft protrudes from the valve body (200) and is connected with the driving mechanism (400).

* * * * *